US011794230B2

(12) United States Patent
Cmiel et al.

(10) Patent No.: US 11,794,230 B2
(45) Date of Patent: Oct. 24, 2023

(54) DRAWING SYSTEM FOR GENERATING PROFILED METAL SECTIONS, AND METHOD FOR AUTOMATICALLY OPERATING SUCH A DRAWING SYSTEM

(71) Applicant: SMS group GmbH, Düsseldorf (DE)

(72) Inventors: Thomas Cmiel, Aachen (DE); Dirk Heßberger, Vaals (NL)

(73) Assignee: SMS group GmbH, Düsseldorf (DE)

( * ) Notice: Subject to any disclaimer, the term of this patent is extended or adjusted under 35 U.S.C. 154(b) by 112 days.

(21) Appl. No.: 17/611,324

(22) PCT Filed: May 12, 2020

(86) PCT No.: PCT/EP2020/063165

§ 371 (c)(1),
(2) Date: Nov. 15, 2021

(87) PCT Pub. No.: WO2020/229457

PCT Pub. Date: Nov. 19, 2020

(65) Prior Publication Data

US 2022/0212238 A1 Jul. 7, 2022

(30) Foreign Application Priority Data

May 13, 2019 (DE) ..... 10 2019 206 878.2

(51) Int. Cl.
*B21C 1/22* (2006.01)
*B21C 51/00* (2006.01)

(52) U.S. Cl.
CPC ..... *B21C 51/00* (2013.01); *B21C 1/22* (2013.01)

(58) Field of Classification Search
CPC .. B21C 1/16; B21C 1/22; B21C 51/00; G01B 21/06; G01B 21/12
See application file for complete search history.

(56) References Cited

U.S. PATENT DOCUMENTS 5,628,218 A * 5/1997 Yamada ..... B21C 9/005 72/289
5,634,363 A * 6/1997 Shozaki ..... B21C 43/04 72/278

(Continued)

FOREIGN PATENT DOCUMENTS

CN 105251789 A 1/2016
CN 205270426 U 6/2016

(Continued)

OTHER PUBLICATIONS

JP 53-11057A, Murakami et al. Feb. 1978.*

(Continued)

*Primary Examiner* — Edward T Tolan
(74) *Attorney, Agent, or Firm* — Maier & Maier, PLLC

(57) ABSTRACT

A drawing system and a method for automatically operating a drawing system. At least one quality-relevant feature of a drawn product, selected from a group of features including the straightness of the drawn product, the length of the drawn product, the diameter and/or at least a thickness of the drawn product, the roundness of the drawn product, and the surface quality of the drawn product, is measured by at least one quality sensor, and the obtained measurement value is processed in at least one control circuit which acts on at least one quality-relevant manipulated variable of the drawing system or parts of the drawing system via at least one controller. At least one reference variable for at least one quality-relevant feature of a specific drawn product is processed in a process controller.

14 Claims, 2 Drawing Sheets

(56) References Cited

U.S. PATENT DOCUMENTS

| | | | | |
|---|---|---|---|---|
| 2002/0043091 | A1 | 4/2002 | Quick et al. | |
| 2013/0160509 | A1* | 6/2013 | Della Vedova | B21B 37/165 72/12.7 |
| 2017/0252867 | A1 | 9/2017 | Bach et al. | |
| 2018/0354053 | A1 | 12/2018 | Zwayer et al. | |

FOREIGN PATENT DOCUMENTS

| | | | | |
|---|---|---|---|---|
| DE | 4108848 | A1 | 9/1992 | |
| DE | 4412268 | A1 | 10/1995 | |
| GB | 2124121 | A * | 2/1984 | B21C 1/00 |
| JP | S58221611 | A | 12/1983 | |
| JP | S59073090 | U | 5/1984 | |
| JP | S6062453 | A | 4/1985 | |
| JP | H02108509 | U | 8/1990 | |
| JP | H06320213 | A | 11/1994 | |
| JP | H10192955 | A | 7/1998 | |
| JP | 2002361318 | A | 12/2002 | |
| JP | 2004337978 | A | 12/2004 | |
| JP | 2007518574 | A | 7/2007 | |

OTHER PUBLICATIONS

CN 109647917A, Liu et al. Apr. 2019.*

JP 56-53816A, Ito et al. May 1981.*

Office Action dated Nov. 24, 2022, in corresponding Japanese Application No. 2021-567958, 10 pages.

International Search Report (with English translation) and Written Opinion (with Machine translation) dated Sep. 4, 2020 in corresponding International Application No. PCT/EP2020/063165; 16 pages.

International Preliminary Report on Patentability dated Dec. 23, 2020 in corresponding International Application No. PCT/EP2020/063165; 37 pages.

Office Action dated Jul. 5, 2023, in corresponding Japanese Application No. 2021-567958, 10 pages.

* cited by examiner

DRAWING SYSTEM FOR GENERATING PROFILED METAL SECTIONS, AND METHOD FOR AUTOMATICALLY OPERATING SUCH A DRAWING SYSTEM

TECHNICAL FIELD

The invention relates to a drawing system for producing metal profiles and a method for automatically operating such a drawing system.

The invention relates in particular to a drawing system for producing metal profiles, comprising at least one quality sensor for detecting at least one quality feature of an intermediate product or an end product of a drawn product, at least one preferably closed control circuit that acts on at least one quality-relevant parameter of the drawing system via at least one controller.

The invention further relates to a method for the automatic operation of a drawing system, in which at least one quality-relevant feature of a drawn product, selected from a group of features comprising the straightness of the drawn product, the length of the drawn product, the diameter and/or at least a thickness of the drawn product, the roundness of the drawn product and the surface quality of the drawn product is measured by means of at least one quality sensor, the measurement value obtained is processed in at least one control circuit, which acts on at least one quality-relevant manipulated variable of the drawing system or parts of the drawing system via at least one controller.

BACKGROUND

Nowadays, drawing systems for drawing, for example, steel, brass, copper as solid material or as a tube are usually set manually by the operator. Such a system comprises a large number of parameters which are set intuitively by the operator and based on his/her experience. Typically, the end product is only checked randomly by the operator himself/herself or by quality assurance. Quality features of the finished metal profile are, for example, straightness, length tolerance, diameter tolerance, quality of the surface roughness or the chamfer and plane geometry of the ends.

A drawing system of the generic type as a so-called "continuous drawing machine" is known, for example, from DE 41 08 848 A1. This document describes a drawing system with a continuous drawing machine with two clamp carriages and a drawing nozzle mounted in a hollow ball, the rotational position of which is set by adjusting means. With the angular setting of the drawing nozzle, the straightness result of the drawn wire is improved. The straightness deviation of the wire is measured on the outlet side of the drawing machine at a guide funnel. An automatic adjustment of the adjusting means takes place via a control circuit on the basis of the measured straightness result.

DE 44 12 268 A1 describes a method for the automatic operation of a control and regulation device for the drawing drives of a drawing machine. In this method, the variables required for the process-dependent control of the drives are derived from the speed, torque and power consumption of the drives.

The prior art described above only contributes to partial aspects of the productivity of a drawing system. In particular, the known solutions do not take into account the problem that a drawing system has to be set again when a product is changed and that a plurality of parameters have to be reset for setting or configuring the machine.

U.S. 2018/354053 A1 discloses a drawing system for producing welding wire. This system comprises a means for heating the welding wire, a control circuit being provided to control the heating temperature, with which the heating power is regulated.

Further prior art is known from U.S. 2002/043091 A1.

SUMMARY

The invention is based on the object of providing a drawing system and a method for the automatic operation of the drawing system with which the quality of the end product can be reproduced to a high degree.

The object on which the invention is based is achieved by the features of preferred embodiments of the invention.

The drawing system according to the invention is characterized in particular by at least one process controller in which at least one reference variable of the closed control circuit is processed in relation to a specific drawn product in the form of an intermediate product and/or end product in the form of an adjustable operating point of the drawing system or individual parts of the drawing system.

The process controller can comprise at least one self-learning algorithm that determines an optimal operating point of the drawing system or of parts of the drawing system based on a specific drawn product.

The relevant operating point can be operated automatically by the process control.

It is expediently provided that the drawing system comprises an operating unit with which the desired or optimal operating point of the drawing system or parts of the drawing system can be selected, the operating unit acting on the at least one controller that automatically sets the relevant operating point of the drawing system or of the relevant part of the drawing system.

Furthermore, it can be provided that the operator of the drawing system is suggested via a display on the operating unit to operate a certain product-specific operating point of the drawing system.

An advantage of the drawing system according to the invention is also to be seen in the fact that the drawing system according to the invention makes it possible to output end and/or intermediate products according to predefined qualities, for example according to predefined tolerance classes or according to defined test certificates.

The process controller can use the display of the operating unit to output a suggestion for an operating point to be operated in relation to a specific drawn product and optionally also for an individual quality feature that is to be influenced. The operator can then manually select the corresponding operating point.

The process controller can comprise a memory and evaluation unit in which a product-specific operating point can be stored and from which such an operating point can be retrieved by means of at least one operating unit.

The drawing system according to the invention can be designed for drawing, for example, steel, brass, copper, aluminum or other non-ferrous metals, both as solid material or tubular or in the form of any other profiles. The drawing system according to the invention can be designed, for example, as a drawing system for bright steel.

A drawing system within the meaning of the present invention comprises, for example, system parts in the form of jigs, blasting systems, pusher devices, drawing units, profile straighteners, guillotine shears, in particular hydraulic guillotine shears, pipe guides, roll straightening machines, beveling machines and the like.

According to the invention, one or more control circuits are provided on the drawing system according to the invention, which check the intermediate or end product of the drawing system and optimize the product by changing parameters.

The quality sensor is selected from a group of quality sensors comprising at least one sensor for detecting the straightness of the drawn product, at least one sensor for detecting the diameter and/or the thickness of the drawn product, at least one sensor for detecting the length of the drawn product, at least one sensor for detecting the surface quality of the drawn product and at least one sensor for detecting the roundness, the quality of the chamfered ends of the drawn product or the other dimensional accuracy of the drawn product.

Measurement values from the detection of the straightness of an intermediate product or an end product can be used, for example, for the automatic setting of jigs, die holders or profile straightening devices or for setting straightening and polishing machines, with setting in the sense of the invention being understood to mean an automatic setting using at least one preferably closed control circuit. This setting is preferably carried out continuously during operation of the drawing system or during operation of the relevant system parts.

Measurement values from a diameter measurement can be used, for example, to set a straightening and polishing machine. Surface measurements, for example a roughness measurement at an intermediate product, can be used, for example, to optimize the blasting power of a blasting system in the manufacture of bright steel. The surface measurement can be carried out, for example, before or after descaling.

The drawing system preferably comprises a plurality of control circuits, each control circuit acting on a different quality-relevant parameter of the drawing system or of parts of the drawing system.

In a preferred variant of the drawing system according to the invention, the memory and evaluation unit acts on a control unit which controls a plurality of controllers.

The object on which the invention is based is further achieved by a method for the automatic operation of a drawing system with the features described above, in which at least one quality-relevant feature of a drawn product, selected from a group of features comprising the straightness of the drawn product, the length of the drawn product, the diameter and/or at least a thickness of the drawn product, the roundness of the drawn product, the dimensional accuracy of the chamfered ends of the drawn product and the surface quality of the drawn product is measured by means of at least one quality sensor, the measurement value obtained is processed in at least one control circuit that acts on at least one quality-relevant manipulated variable of the drawing system or parts of the drawing system via at least one controller, wherein at least one reference variable for at least one quality-relevant feature of a specific drawn product in the form of an intermediate product and/or end product is processed, the reference variable defining an operating point of the drawing system or parts of the drawing system or being used to define an operating point of the drawing system or parts of the drawing system and the operating point being adjustable on the basis of a specific drawn product.

The process controller can comprise at least one self-learning algorithm that determines an optimal operating point of the drawing system or of parts of the drawing system based on a specific drawn product.

The relevant operating point can be operated automatically by the process control.

Alternatively, it can be provided to select the desired or optimal operating point of the drawing system or parts of the drawing system via an operating unit which acts on the at least one controller that automatically sets the relevant operating point of the drawing system or of the relevant part of the drawing system.

Alternatively, the method can provide that the operator of the drawing system is suggested via a display at the operating unit to operate a certain product-specific operating point of the drawing system.

In this way, for example, when a product is changed, the drawing system can be automatically set to the new product or to the new drawn product with all the parameters required for this purpose. This reduces any retooling times and waste when starting up the drawing system.

In an expedient variant of the method according to the invention, it is provided that the process controller comprises a memory and evaluation means in which at least one operating point of the drawing system is stored.

A plurality of quality-relevant features of the drawn product are preferably measured, with each measurement value being processed in at least one control circuit.

For example, it can be provided that an operating point of the drawing system or of parts of the drawing system is defined by a plurality of reference variables.

A variant of the method is characterized in that at least one measurement value is processed in a plurality of control circuits.

A product-specific operating point can be defined via a plurality of control circuits of the drawing system.

In a particularly preferred variant of the invention, it is provided that an operating point of the drawing system is optimized during operation in relation to a specific drawn product in each case. This optimum operating point is stored as the best setting in relation to a specific drawn product in the memory and evaluation unit of the drawing system.

In a drawing system of the type mentioned at the outset, several system parts or units may have an influence on a single quality-relevant feature of the intermediate product or the end product of the drawn product. Several parts of the system can, for example, have an influence on the straightness of the drawn product. Therefore, in a preferred variant of the method, it can be provided that a single measurement value for a certain quality-relevant feature of a drawn product is processed as a reference variable in control circuits of successive parts of the drawing system and that the control circuits of the successive parts of the drawing system are linked with one another in a cascade manner, so that manipulated variables for successive parts of the drawing system are derived from the control deviation, one after the other and/or in parallel.

BRIEF DESCRIPTION OF THE FIGURES

The invention is explained below with reference to the accompanying drawings, in which.

DETAILED DESCRIPTION

Figure 1:
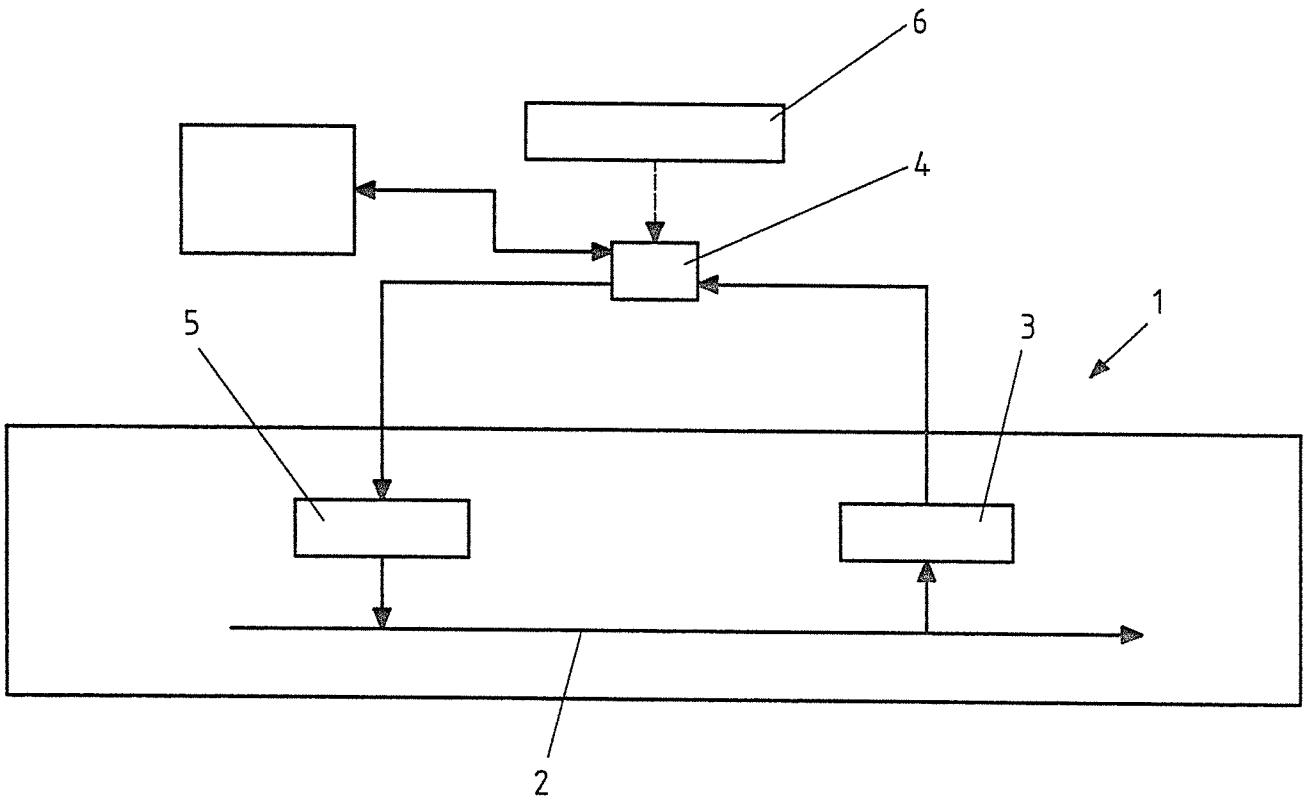
FIG. 1 shows a schematic illustration of a closed control circuit at a drawing system according to the invention.

FIG. 1 shows schematically an automatic control at a drawing system 1 according to the invention as a block diagram. The drawing system 1 can be designed, for example, to produce bright steel from a wire produced by a continuous casting process and subsequent rolling. A workpiece 2 as drawn product, for example in the form of a round wire, passes through the drawing system 1 from left to right, with a quality feature of the wire (for example thickness, diameter, roughness, straightness or dimensional accuracy of a chamfered end of the drawn product) being measured with a quality sensor 3 on the output side. The measurement value obtained is fed to a process controller 4. The process controller 4 comprises a memory and evaluation unit as well as at least one controller which, by outputting a corresponding manipulated variable, acts on an actuating means 5 to influence a quality-relevant parameter of the drawing system 1. External information can be entered into the process controller 4 via an operating unit 6. A product-specific operating point of the drawing system 1 can be set via the operating unit.

Figure 2:
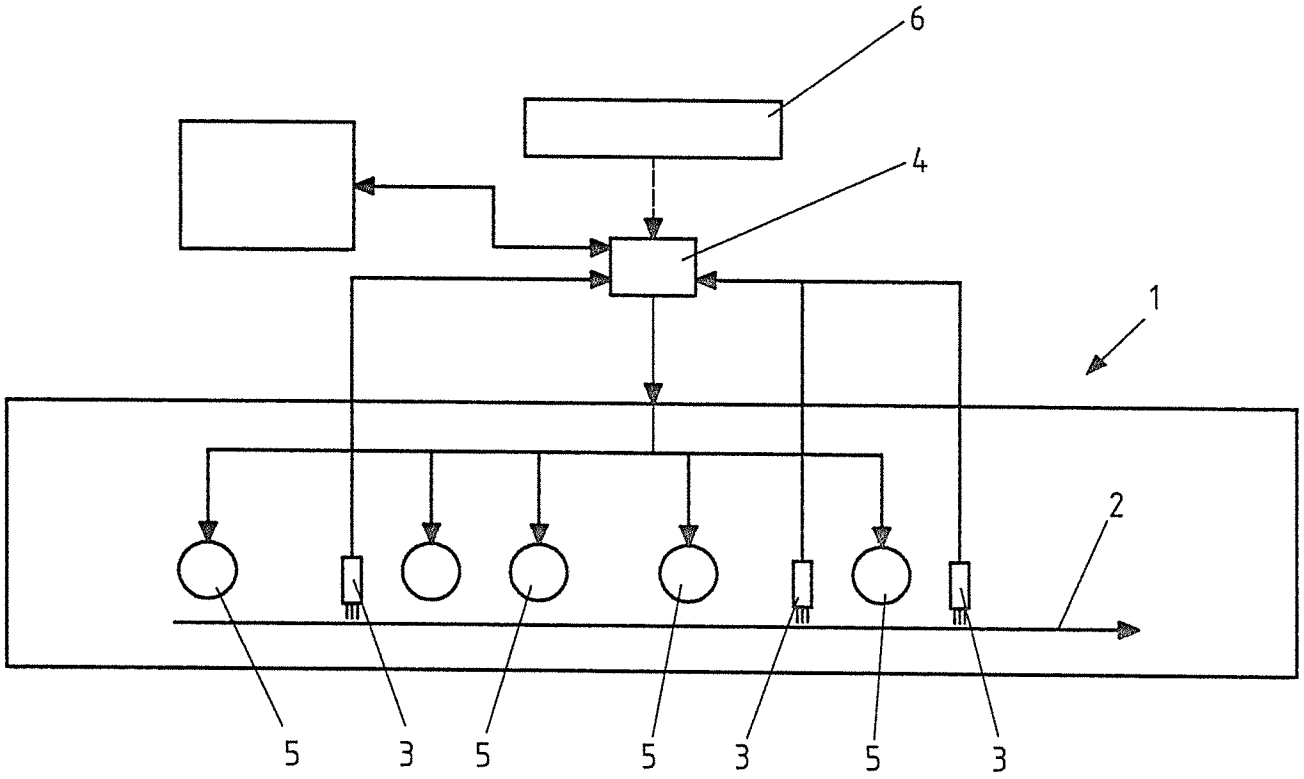
FIG. 2 shows a schematic illustration of the control scheme with several closed control circuits at a drawing system according to the invention.

The block diagram according to FIG. 2 expands the control scheme shown in FIG. 1 to include a plurality of quality sensors 3 and a plurality of actuating means 5 for the drawing system 1 according to the invention. Identical parts are provided with corresponding reference numerals. Otherwise, the block diagram according to FIG. 2 corresponds in principle to that according to FIG. 1.

LIST OF REFERENCE NUMERALS

1 drawing system
2 workpiece
3 quality sensor
4 process control
5 actuating means
6 operating unit

The invention claimed is:

1. A drawing system for producing metal profiles, comprising a plurality of control circuits that are configured to act on at least one quality-relevant parameter of the drawing system via at least one controller, at least one process controller that is configured to process at least one reference variable of each control circuit in relation to a specific drawn product in at least one of an intermediate product and an end product and either an adjustable operating point of the drawing system or individual parts of the drawing system, at least one quality sensor that is configured to continuously detect at least one quality feature of the intermediate product or the end product of a drawn product, wherein the at least one quality feature is selected from a group of features respectively corresponding to a group of quality sensors and the at least one quality sensor is selected from the group of quality sensors comprising:

a sensor configured to detect the straightness of the drawn product, a sensor configured to detect the diameter and/or at least one thickness of the drawn product, a sensor configured to detect the length of the drawn product, a sensor configured to detect the surface quality of the drawn product, a sensor configured to detect the roundness of the drawn product, and a sensor for checking the chamfered ends of the drawn product.

2. The drawing system according to claim 1, wherein the operating point for the specific intermediate product or the end product can be selected via an operating unit which acts on the at least one controller which automatically sets the operating point of the drawing system for a specific drawn product.

3. The drawing system according to claim 1, wherein the at least one process controller further comprises:

at least one memory configured to store the operating point for the specific intermediate product or the end product.

4. The drawing system according to claim 1, wherein each control circuit is configured to act on a different quality-relevant parameter of the drawing system or of parts of the drawing system.

5. The drawing system according to claim 1, wherein the at least one process controller is configured to act on each control circuit.

6. A method for the automatic operation of a drawing system of claim 1, comprising:

measuring the at least one quality-relevant feature of a drawn product, processing an obtained measurement value in each control circuit which acts on at least one quality-relevant manipulated variable of the drawing system or parts of the drawing system via at least one controller;

processing at least one reference variable for at least one quality-relevant feature of a specific drawn product in the form of an intermediate product and/or end product in the at least one a process controller; and defining the reference variable an operating point of the drawing system or parts of the drawing system on the basis of a specific drawn product.

7. The method according to claim 6, further comprising:

storing at least one operating point of the drawing system in a memory of the at least one process controller.

8. The method according to claim 6, wherein a plurality of quality-relevant features of the drawn product are measured, that each measurement value is processed at least in each control circuit.

9. The method according to claim 6, further comprising:

defining an operating point of the drawing system or of parts of the drawing system by a plurality of reference variables.

10. The method according to claim 6, wherein at least one measurement value is processed in the plurality of control circuits.

11. The method according to claim 6, wherein a product-specific operating point is defined via the plurality of control circuits of the drawing system.

12. The method according to claim 6, further comprising:

optimizing an operating point of the drawing system during operation in relation to a specific drawn product.

13. The method according to claim 6, further comprising:

detecting at least one measurement value continuously during the operation of the drawing system.

14. The method according to claim 6, further comprising:

processing a single measurement value for a certain quality-relevant feature of a drawn product as a reference variable in each control circuits of respectively successive parts of the drawing system and the plurality of control circuits of the successive parts of the drawing system are linked to one another; and deriving manipulated variables for successive parts of the drawing system from the control deviation.

* * * * *